United States Patent [19]

Tietje

[11] Patent Number: 4,556,795

[45] Date of Patent: Dec. 3, 1985

[54] CORONA DISCHARGE DEVICE

[75] Inventor: Andreas Tietje, Tariffville, Conn.

[73] Assignee: Ensign-Bickford Industries, Inc., Simsbury, Conn.

[21] Appl. No.: 523,169

[22] Filed: Aug. 15, 1983

Related U.S. Application Data

[63] Continuation-in-part of Ser. No. 443,065, Nov. 19, 1982, abandoned.

[51] Int. Cl.[4] ..... G03G 15/00

[52] U.S. Cl. ..... 250/324; 250/325

[58] Field of Search ..... 250/324, 325, 326, 423 R; 361/225, 230, 231; 355/3 CH

[56] References Cited

U.S. PATENT DOCUMENTS

| | | | |
|---|---|---|---|
| 2,863,063 | 11/1955 | Schultz | 361/225 |
| 3,684,364 | 9/1972 | Schmidlin | 250/325 |
| 3,725,736 | 4/1973 | Bishop | 361/230 |
| 3,778,690 | 12/1973 | Rothacker et al. | 250/325 |
| 3,789,222 | 1/1974 | Sato | 250/325 |
| 3,789,278 | 1/1974 | Bingham et al. | 250/326 |
| 3,887,809 | 6/1975 | Marx et al. | 250/325 |
| 3,890,504 | 6/1975 | Pendleton et al. | 250/325 |

FOREIGN PATENT DOCUMENTS

| | | |
|---|---|---|
| 648938 | 1/1951 | United Kingdom . |
| 722875 | 2/1955 | United Kingdom . |
| 1026140 | 4/1966 | United Kingdom . |
| 1227996 | 4/1971 | United Kingdom . |
| 1236998 | 6/1971 | United Kingdom . |
| 1398024 | 6/1975 | United Kingdom . |
| 1503281 | 5/1978 | United Kingdom . |
| 1530819 | 11/1978 | United Kingdom . |
| 2030008 | 3/1980 | United Kingdom . |
| 2067357 | 7/1980 | United Kingdom . |
| 1596577 | 8/1981 | United Kingdom . |

*Primary Examiner*—Alfred E. Smith
*Assistant Examiner*—Richard Hanig
*Attorney, Agent, or Firm*—Hayes & Reinsmith

[57] ABSTRACT

A corona discharge device includes a roll formed of a conductive material and a plurality of segments mounted on a support and arranged in spaced relation from the surface of the roll in an alignment generally parallel to the roll's rotational axis. Each segment includes a hollow insulator having an outer surface adapted to be disposed adjacent to said roll and a wall extending away therefrom. The conductive body is disposed within said insulator and in an opposed relation to said outer surface. The conductive means is coupled to the conductive body and extends outwardly from said insulator for being coupled to said support means for movement of said segment away from said roll. An insulating material can be used to fill the remaining portion of said insulator and to surround said conductive means.

12 Claims, 7 Drawing Figures

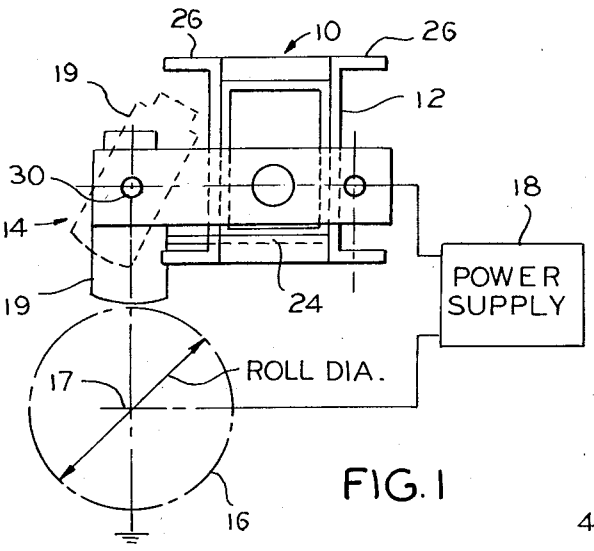
FIG. 1
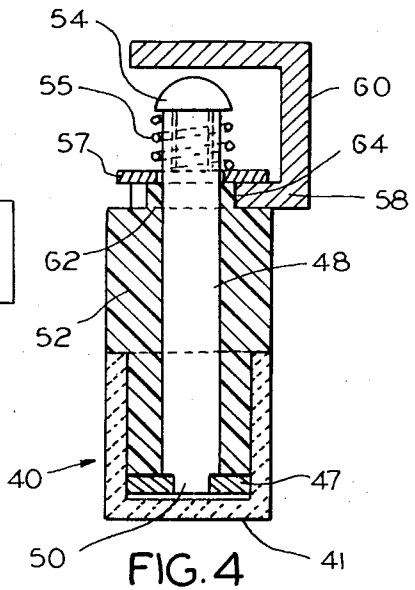
FIG. 4
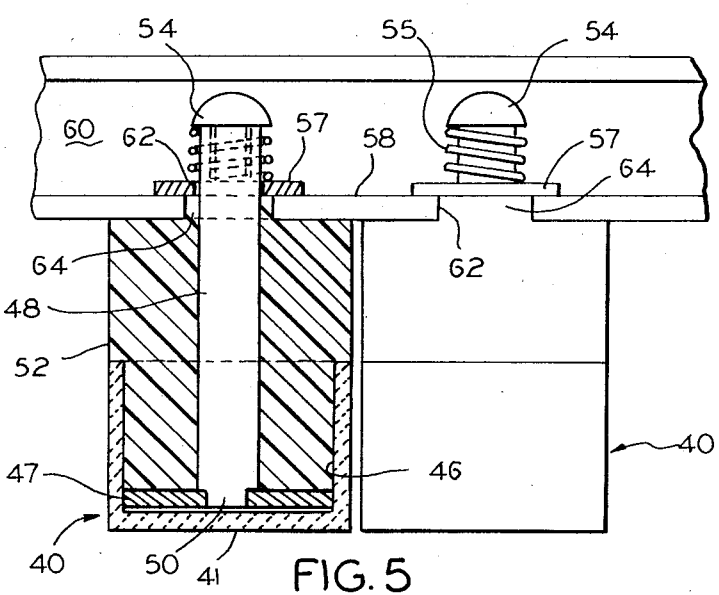
FIG. 5
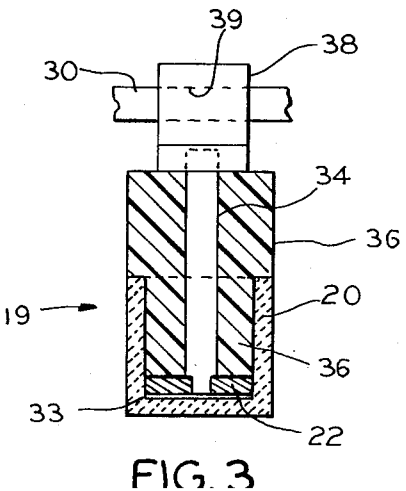
FIG. 3
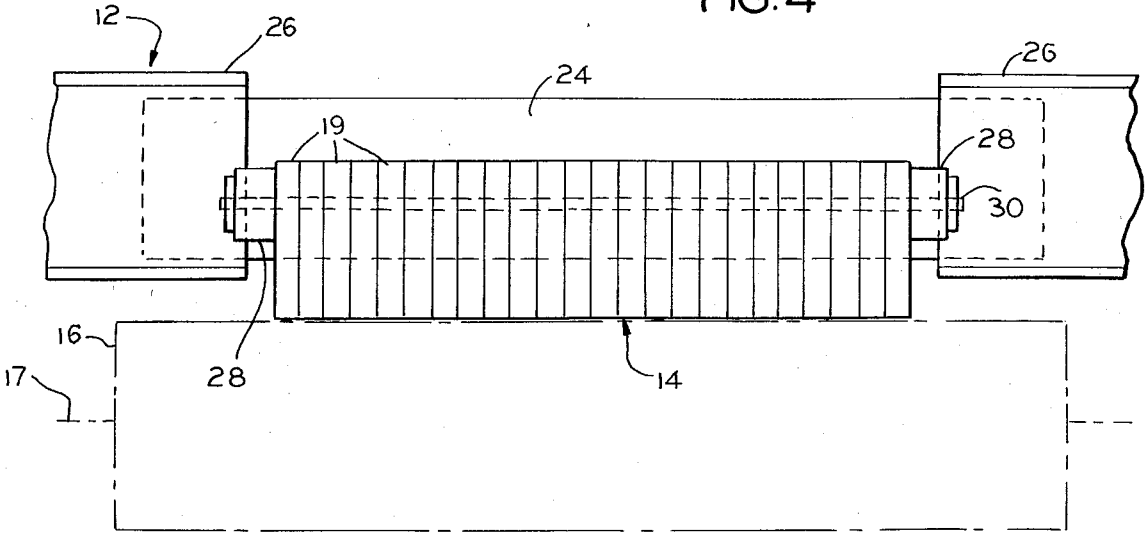

CORONA DISCHARGE DEVICE

BACKGROUND OF THE INVENTION

1. Field of the Invention

This invention relates to electrodes for corona discharge devices and is a Continuation-in-Part of U.S. patent application Ser. No. 443,065 filed Nov. 19, 1982, now abandoned.

2. Description of the Prior Art

Corona discharge devices are employed for the treatment of various materials, such as polyethylene film, which is passed between a pair of electrodes. One of the electrodes is normally covered with a dielectric material. A high voltage discharge between the electrodes bombards the surface of the film to modify it chemically or oxidize its surface. The resultant molecular change substantially improves the wetability of the film surface and prepares the film for coating, printing or any requirement where strong bonding and adhesive quality is required.

One type of prior art corona treaters generally comprise a metallic roll covered with a dielectric material such as hypalon, silicone rubber, or the like. The other electrode may comprise an elongate bar oriented parallel to the axis of the roll and spaced from its surface. A high voltage alternating at a frequency of 10,000 Hz, for example, is applied between the bar and the roll causing a corona discharge therebetween. The material being treated is passed over the roll to provide the desired surface treatment.

Prior art corona treating apparatus of this first type have not been wholly satisfactory because electrical stresses and physical damage require frequent replacement of the roll dielectric.

A second type of prior art corona treaters generally comprises a bare metallic roll as one electrode. The other electrode comprises one or more elongate bar structures oriented parallel to the axis of the roll and spaced from its surface. Said bar structures comprise an inner conductive member and a monolithic outer dielectric covering. The dielectric covering may be an elastomeric material such as silicone rubber, or a vitreous material such as glass or fused quartz, or a ceramic material.

Prior art corona treating apparatus of this second type have not been wholly satisfactory owing to failure of the dielectric covering. Elastomeric materials are subject to failure by chemical attack, temperature, voltage stress, and physical damage such as abrasion or cutting. Vitreous materials are subject to failure by temperature and physical shock. Ceramic materials have been subject to failure by voltage stress, thermal shock, and physical shock. The fragility of a vitreous or ceramic covering is enhanced by the monolithic structure.

OBJECTS OF THE INVENTION

It is an object of the invention to provide a new and improved corona treating apparatus.

Another object of the invention is to provide an improved electrode for corona treating apparatus which is resistant to electrical stress or physical damage.

A further object of the invention is to provide a corona treating device in which repair of the dielectric covered electrodes is substantially easier than in prior art devices.

Still another object of the invention is to provide a corona treating device having an insulator for covering electrodes which permits ceramic formulation and processing to attain optimum thermal, electrical and mechanical properties.

These and other objects and advantages of the present invention will become more apparent from the detailed description thereof taken with the accompanying drawings.

SUMMARY OF THE INVENTION

In general terms, the invention comprises a corona discharge device including a roll formed of a conductive material and adapted to rotate about a rotational axis and an electrode structure comprising a plurality of electrode segments. A support is provided for mounting the segments adjacent the surface of the roll. Each segment includes a hollow insulator having an outer surface adjacent the roll and a wall extending away therefrom. A conductive body is disposed within the insulator and in an opposed relation to the roll. Conductive means is connected to the conductive body and extends outwardly from said insulator for being coupled to the support, and, if desired, a solid insulating material can be used to fill the remaining portion of the insulator and surround the conductive means. The insulator is made in a shape which lends itself to ceramic compounding and manufacturing techniques which maximize dielectric strength, resistance to thermal shock and other desirable properties. These properties are also enhanced by its inherent small size. The insulator is preferably formed of a high alumina ceramic material which may be about 90–99.5% alumina and preferably about 94–99.5% alumina.

BRIEF DESCRIPTION OF THE DRAWINGS

FIG. 1 schematically illustrates a plastic treater in accordance with one embodiment of the present invention;

FIG. 2 is a front view of the plastic treater illustrated in FIG. 1;

FIG. 3 is a fragmentary view, partly in section, of a portion of the treater illustrated in FIG. 1;

FIG. 4 is a fragmentary front view of an alternate embodiment of the invention;

FIG. 5 is a fragmentary side elevational view of the embodiment illustrated in FIG. 4.

DESCRIPTION OF THE PREFERRED EMBODIMENT

Figure 7:
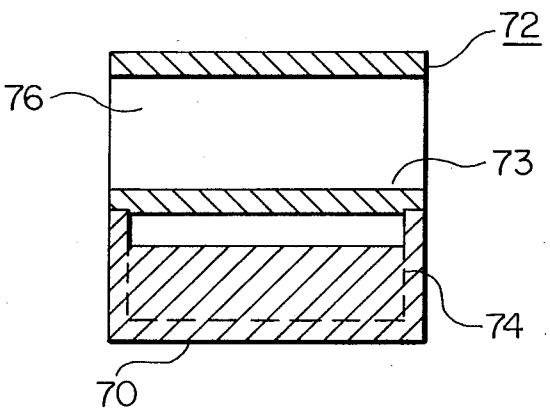
FIG. 7 is a cross-section view taken along the lines 7—7 of FIG. 6.

FIG. 1 schematically illustrates a plastic treater 10 to include a support frame 12, a segmented treater bar 14 mounted on frame 12, a metallic roll 16 mounted for rotation about an axis 17 which is parallel to the treater bar 14, and a power supply 18 coupled to the treater bar 14 and the roll 16.

As seen in FIG. 3, and as will be discussed more fully hereinbelow, the treater bar comprises a plurality of electrode segments 19, each of which includes an outer cup-shaped member 20 of a ceramic dielectric material surrounding conductive member 22. The power supply 18 is of the type conventionally employed for corona discharge devices and its details form no part of the present invention. Accordingly, the power supply will not be discussed in detail for the sake of brevity. As those skilled in the art will appreciate however, the power supply is of a type that provides a high voltage wave which alternates at a frequency in the order of 6 to 30 KHZ, for example. The power supply is connected to the roll 16 to the treater bar 14 and in particular to the conductive body 22. As a result, a corona discharge will occur between the individual segments 19 and the roll 16 which is grounded and may comprise stainless steel, for example.

The frame 12 compises a box beam member 24 and a pair of channel members 26 disposed at each of its opposite ends. In particular, the channel members of each pair are disposed in spaced relation and are suitably fixed to the opposite side surfaces of the box beam 24. Extending forwardly from the box beam 24 and adjacent its opposite ends, are a pair of bracket members 28. A rod 30 extends between brackets 28 and through each of the segments 19 for pivotally mounting the same as will be discussed more fully below. When the segments 19 are in their operative position, as shown in FIGS. 1 and 2, a gap will be provided between the lower ends and the roller 16. As those skilled in the art will appreciate, either the frame 12 or the roll 16 may be adjustably mounted relative to the other so that the gap between the segments 19 and roll 16 may be adjusted.

Each of the segments 19 are shown more particularly in FIG. 3 to include a cup-shape member 20. The body 22 may comprise any conductive material, such as aluminum, and is disposed at the bottom of the cup-shaped member 20. An epoxy material 33 may be employed to secure the body 22 in position. A stud 34 extends axially upwardly from and is in electrical contact with the body 22. If desired, insulating material 36 such as teflon or ceramic fills the remaining portion of the cup-shaped member 20 and surrounds the stud 34 except for its exposed upper end which is threadably received in a bearing member 38. As seen in FIG. 3, the rod 30 extends through a complimentary opening 39 in the bearing member 38. As a result, each segment 19 is pivotally mounted on and electrically connected to the rod 30.

Preferably, the cup-shape members 20 are a ceramic material formed of primarily aluminum oxide and are fabricated by high pressure and heat so as to minimize porosity. A high purity aluminum oxide has been found to be satisfactory, such as, for example, from about 90% to about 99.5% aluminum oxide and preferably about 94–99.5% aluminum oxide.

FIG. 2 shows all of the segments 19 in their operative position as would be the case when film of the maximum width is being treated. However, when narrower films are being processed it is advantageous to pivot one or more of the segments 19 out of their operative positions. This is accomplished by pivoting those segments which are not required in a clock-wise direction as shown by broken lines in FIG. 1, until they engage the box beam member 24.

FIGS. 4 and 5 disclose segments 40 according to an alternate embodiment of the invention. Segments 40 include cup-shape members 41 and conductive material 47 positioned at the bottom of member 41.

The segment 40 also includes a pin 48 connected at its lower end by a reduced diameter section 50 to the conductive body 47. Pin 48 extends upwardly therefrom and through the body of teflon material 52 where its upper end extends outwardly therefrom for threadably receiving the shank of a head 54 which is threaded into an axial recess in its upper end. A spring 55 is disposed around the upper end of pin 48 and between the head 54 and a washer 57 disposed in surrounding relation to the extending end of pin 48.

As seen in FIGS. 4 and 5, the elements 40 are mounted in a side-by-side manner in the lower flange 58 of a channel support member 60. In particular, the flange 58 has a plurality of open ended slots which receive a reduced neck portion 64 of the body 52. It can be seen that the neck portion 64 has a height slightly less than the thickness of flange 58 and a width equal to that of the slot 62.

When the segments 40 are in the operative position as shown in FIGS. 4 and 5, wherein the neck portions 64 disposed within the slot 62, the springs 55 resiliently urge the washer 57 against the top surface of the flange 58 so that the planer upper surface of the body 52 is retained against the lower surface of flange 58. When it is desired to remove on or more of the segments 40, they are merely pulled vertically downward slightly to compress the spring 55 thereby relieving pressure between the body 52 and the flange 58 so that the same may be slid forwardly and out of the slot 62.

Figure 6:
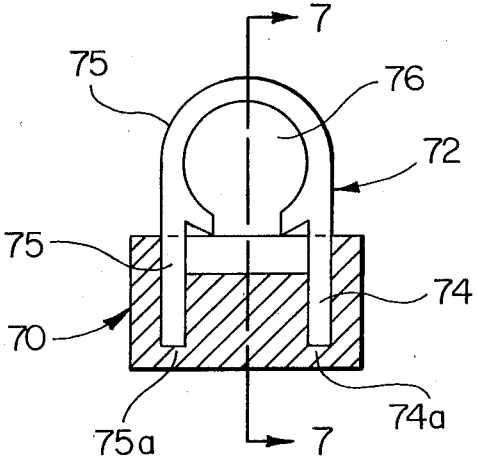
FIG. 6 is a cross-section view of an alternative construction of the electrode segment.

By way of further illustration, it is apparent that a variety of differing forms of the conductive body or member can be placed in a hollow insulator to form each segment. In FIGS. 6 and 7, a cup-shaped member 70, similar to the cup-shaped members 20 and 40 of FIGS. 3 and 4, respectively, and of any suitable dimensions, is illustrated. The conductive member 72 is shown as being generally C-shaped in cross section to provide an upper body portion 73 and two legs 74 and 75. Upper body 73 has a generally circular aperture 76 which is designed as a mounting aperture such as with rod 30 of FIG. 1. The end faces **74*a* and 75*a* of legs 74 and 75 present a combined electrode area facing roll 16, much as the conductive member 22 of FIG. 3, to produce the desired corona treatment effect. Such electrode area is a variable related to the voltage and frequency of power supply 18** as well as the desired magnitude of corona treatment.

The legs 74 and 75 are inherently resilient if conductuve member 72 is formed of a metal such as aluminum; with deflection towards each other being required for insertion into cup-shaped member 70, the cup will be removeably retained on the conductive member 72 by the diverging resilient force of the legs 74 and 75 thereby to eliminate the need for other mounting means.

It is also observed that use of insulating materials 36 of FIG. 3 such as teflon or ceramic is not required but rather selectively used depending upon operating conditions including the parameters of power supply 18. Moreover, the materials selected for use in constructing the cup-shaped member (hollow insulator) can be determined, as desired, to provide appropriate temperature resistance, insulating properties, dielectric constant, o-zone resistance and other operating parameters associated with the particular conora treatment apparatus.

FIGS. 2 and 5 illustrate two other important features of this invention. First, it may be seen that an overall electrode structure of any desired length can be made from standard elements. Second, it may also be seen that damage to a single element requires only the replacement of that element, greatly reducing the cost and time in contrast to replacing a complete electrode structure.

Additionally, it is apparent that overall dimensional accuracy of the structures of FIG. 2 or FIG. 5 can be maintained despite inherent lack of precision in ceramic parts. Furthermore, the problems of thermal stress and distortion inherent with monolithic ceramic structures are eliminated.

While only a few embodiments of the invention have been illustrated and described, it is not intended to be limited thereby but only by the scope of the appended claims.

I claim:

1. A corona discharge device including a first electrode formed of a conductive material, a plurality of segments, support means for mounting said segments in an operative position adjacent said first electrode, each segment including a hollow insulator defined by an outer surface adjacent said first electrode and a wall extending away therefrom, a conductive body disposed within said insulator and in an opposed relation to said first electrode, conductive means connected to said conductive body and extending outwardly from said insulator for being coupled to said support means, and an insulating material filling the remaining portion of said insulator and surrounding said conductive means.

2. The corona discharge device according to claim 1, wherein said first electrode is a roll adapted to rotate about a conductive axis, said segments being arranged adjacent the surface of said roll and in general parallelism with said axis.

3. The corona discharge device set forth in claims 1 or 2 wherein said insulator is formed of a high alumina ceramic material.

4. The corona discharge device set forth in claim 3 wherein said ceramic material is about 90–99.5% alumina.

5. The corona discharge device set forth in claim 4 wherein said ceramic material is about 94–99.5% alumina.

6. The corona discharge device set forth in claims 1 or 2 wherein said conductive means is coupled to said support means for movement of said segment into and out of its operative position relative to said first electrode.

7. The corona discharge device set forth in claims 1 or 2 wherein said insulator includes side walls arranged in a generally parallelogram array, said segments being mounted on said support means when in their operative positions in a side-by-side relation and with adjacent side walls in general parallelism.

8. The corona discharge device set forth in claim 7 and including resilient means for resiliently securing said segments to said support means.

9. The corona discharge device set forth in claim 8 wherein said support means comprises an elongate bar having a plurality of slots formed in one side thereof, said conductive means including a pin slidably received in one of said slots and a spring surrounding said pin for resiliently urging said segment against said bar.

10. A terminal segment for a corona discharge device comprising a generally cup-shaped hollow insulator having an end wall and side walls extending away therefrom, a conductive body disposed at least partially within said insulator with at least a portion thereof in an opposed relation to said end wall, means extending outwardly from said insulator for being coupled to a support means, and means retaining said insulator on said conductive body with said end wall and conductive body in juxtaposition.

11. The terminal segment of claim 10 wherein the portion of said conductive body which extends into said insulator comprises opposed resilient legs in retaining engagement with the inner surface of said cup-shaped insulator.

12. An insulator for a corona discharge device having a plurality of terminal segments each of which segments includes a conductive body, comprising a generally cup-shaped electrically insulating ceramic body having an end wall and side walls, the open end of said ceramic body being dimensioned to receive a conductive body with the end thereof in juxtaposition with the inner-end wall of the cup-shaped electrically insulating ceramic body.

* * * * *